United States Patent [19]

Brackett

[11] Patent Number: 4,930,990

[45] Date of Patent: Jun. 5, 1990

[54] QUIET CLUTCH FAN BLADE

[75] Inventor: Stephen E. Brackett, Blenheim, Canada

[73] Assignee: Siemens-Bendix Automotive Electronics Limited, Chatham, Canada

[21] Appl. No.: 407,821

[22] Filed: Sep. 15, 1989

[51] Int. Cl.[5] ..... B63H 1/18; B63H 1/26

[52] U.S. Cl. ..... 416/223 R; 415/119; 416/238

[58] Field of Search ..... 416/223 R, 223 A, 234, 416/238, 240, 241 A, 242, 243, DIG. 2, DIG. 5; 415/119

[56] References Cited

U.S. PATENT DOCUMENTS 3,972,646 8/1976 Brown et al. ..... 416/223 R
4,284,388 8/1981 Szewalski ..... 415/119
4,358,246 11/1982 Hanson et al. ..... 415/119
4,684,324 8/1987 Perosino ..... 416/238

FOREIGN PATENT DOCUMENTS 0044799 3/1982 Japan ..... 416/DIG. 2

*Primary Examiner*—Robert E. Garrett
*Assistant Examiner*—Hoang Nguyen
*Attorney, Agent, or Firm*—George L. Boller; Russel C. Wells

[57] ABSTRACT

A clutch fan has a new and unique blade design that results in quieter and more efficient operation. The blade design involves the leading edge having inner, intermediate, and outer regions such that the intermediate region is of increasing skew in the direction of rotation and the outer region is of decreasing skew. The pitch ratio increases as a function of increasing blade radius. Along the outer region, the blade increases in pitch on a defined curvature as a function of blade radius and angle to form a tip curl.

3 Claims, 4 Drawing Sheets

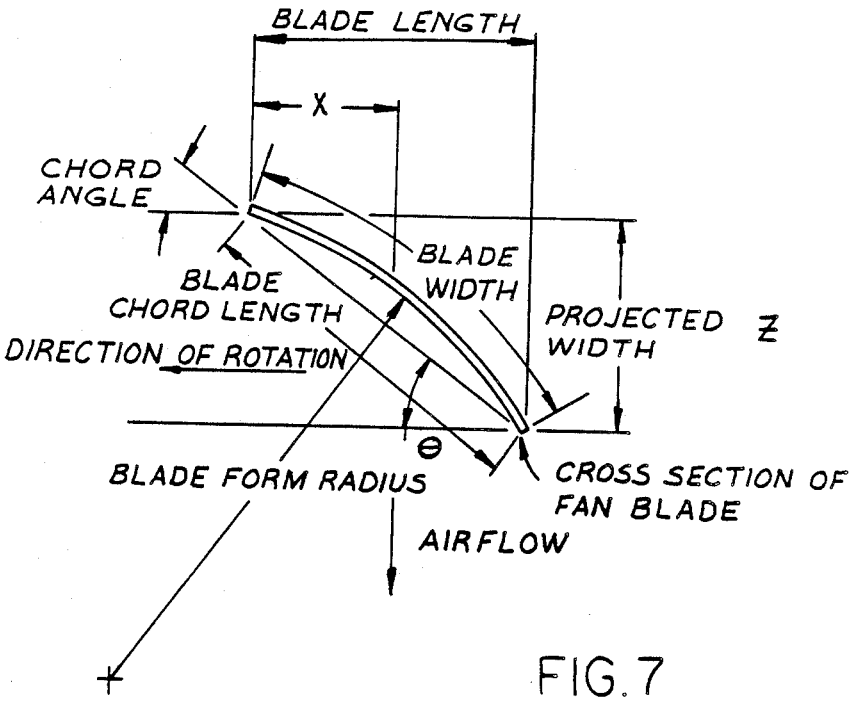
FIG. 7
FIG. 8
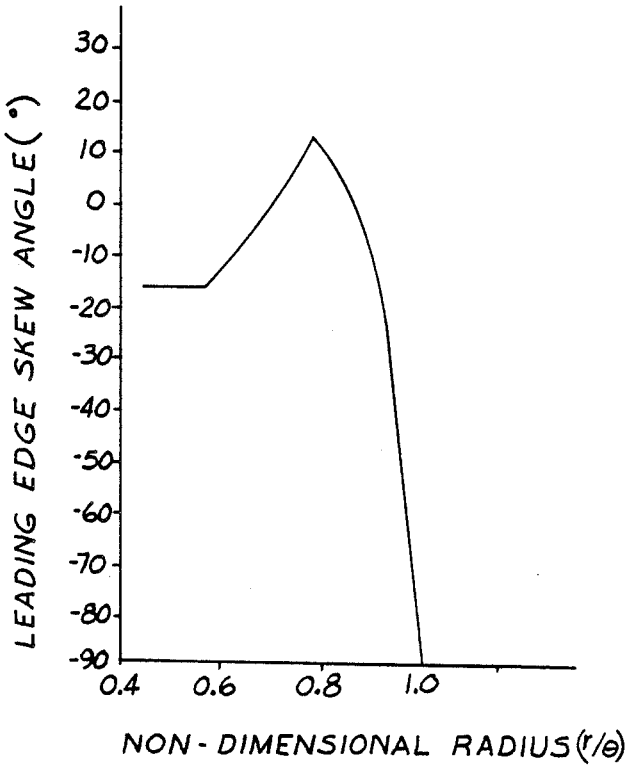

QUIET CLUTCH FAN BLADE

BACKGROUND AND SUMMARY OF THE INVENTION

This invention relates to fans of the type that are used in automotive vehicles for drawing air through radiators, particularly, clutch fans. The invention involves an improvement to the blades of such fans resulting in quieter and more efficient operation.

Clutch fans are employed in vehicles in which the engines are mounted in the "north-south" direction. The fan is mounted on an external portion of the engine water pump's shaft via a clutch. The size or capability of the clutch is determined by the input speed of the water pump, generally 1.25 times the engine rpm, and the torque of the clutch fan. Generally, the airflow required for cooling the vehicle determines the torque of the fan if the fan is properly designed.

Conventional bladed clutch fans can best be described as having a certain number of blades, commonly five or seven, of radial (non-skewed) blade profile. The material of the blades may be either steel or aluminum or plastic. These fans have in the past been used for their cooling performance at the expense of fan noise, even though the noise level has been considered acceptable.

With the present invention, the required cooling performance can be achieved, or even improved, while the sound pressure levels generated by the fan can be significantly attenuated. Moreover, the fan torque is reduced, allowing the clutch size to be decreased so that a cost saving can be realized.

A fan blade constructed according to general principles of the invention comprises: a varying skew leading edge that has inner, intermediate, and outer regions such that the intermediate region is of increasing skew in the direction of rotation and the outer region is of decreasing skew; the pitch ratio increases as a function of increasing blade radius; and along the outer region of the leading edge, the blade increases in pitch on a defined curvature as a function of blade radius and angle to form a tip curl.

Features, advantages, and benefits of the invention will be seen in the ensuing description, claims, and accompanying drawings which disclose a presently preferred embodiment according to the best mode contemplated at the present time in carrying out the invention.

BRIEF DESCRIPTION OF THE DRAWINGS

FIG. 7 is a diagram useful in explaining certain aspects of the invention.

FIGS. 8, 9, and 10 are graphs useful in explaining various aspects of the invention.

DESCRIPTION OF THE PREFERRED EMBODIMENT

Figure 1:
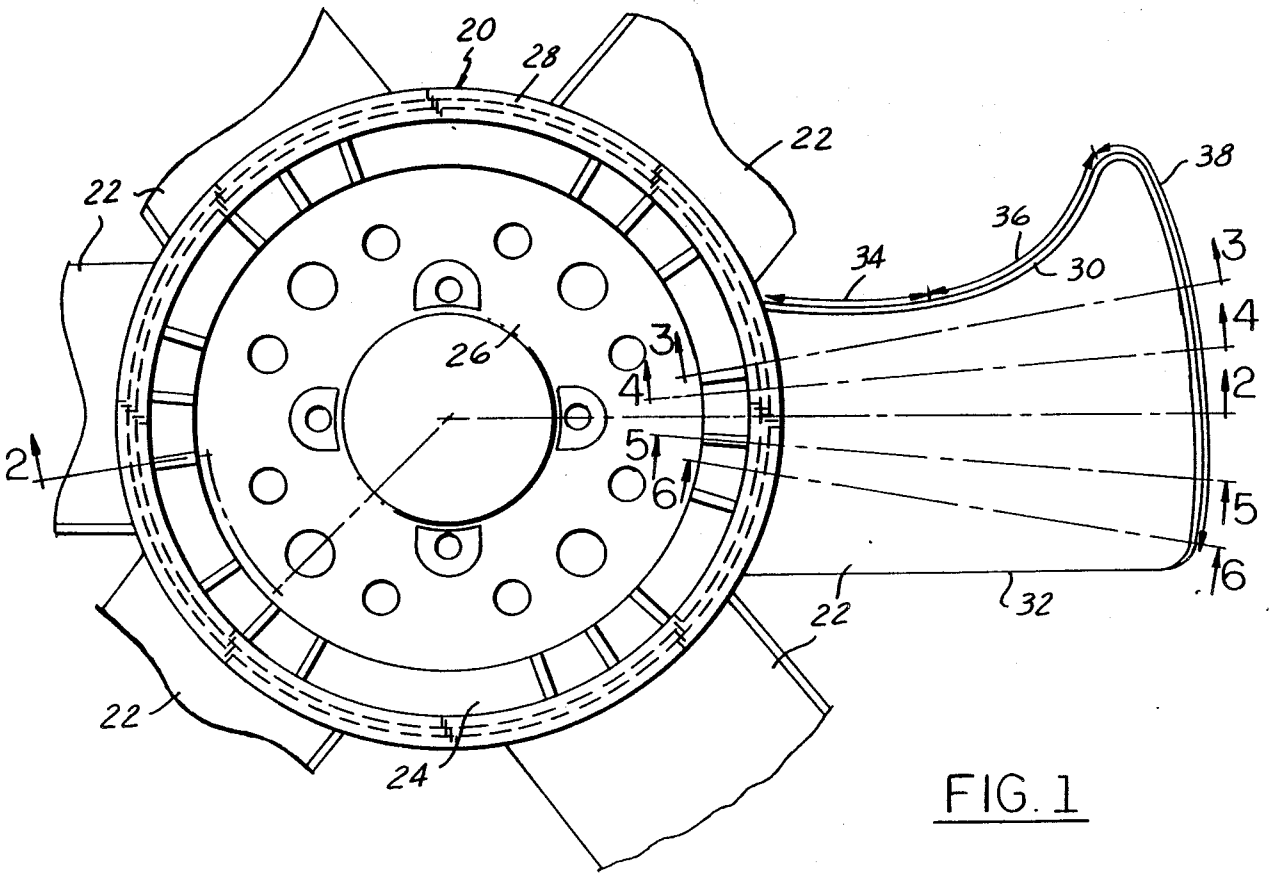
FIG. 1 is a partial view of a fan embodying the invention.
Figure 2:
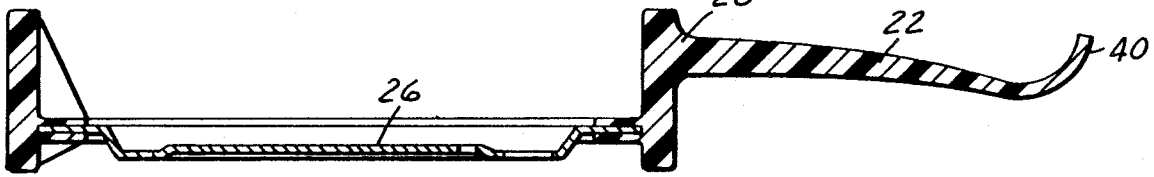
FIG. 2 is a cross sectional view taken in the direction of arrows 2—2 in FIG. 1.
Figure 4:
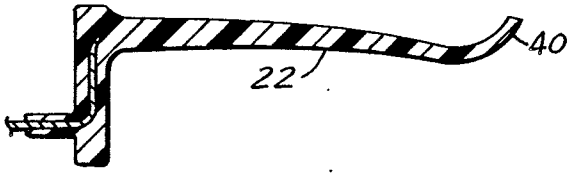
FIG. 4 is a cross sectional view taken in the direction of arrows 4—4 in FIG. 1.
Figure 3:
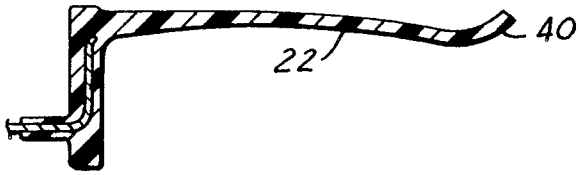
FIG. 3 is a cross sectional view taken in the direction of arrows 3—3 in FIG. 1.
Figure 6:
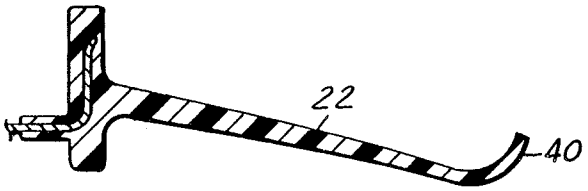
FIG. 6 is a cross sectional view taken in the direction of arrows 6—6 in Fig. 1.
Figure 5:
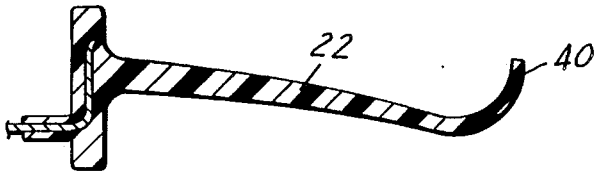
FIG. 5 is a cross sectional view taken in the direction of arrows 5—5 in FIG. 1.

FIGS. 1–6 illustrate a fan 20 having a number of identical blades 22 that radiate from a hub 24. The fan is of two piece construction comprising a metal part 26 and a plastic part 28.

Each blade has a leading edge 30 and a trailing edge 32. The leading edge has a varying skew that consists of an inner zone 34, an intermediate zone 36, and an outer zone 38. The trailing edge is straight For purposes of description, the outer zone 38 of the leading edge continues from the outermost end of the intermediate zone 36 to the outermost end of the trailing edge 32 so that the tip (radially outer portion) of the blade is considered part of the leading edge.

The blade also has a pitch ratio that is continuously increasing with the blade radius. The pitch at a given radius from the center of the hub can be determined from the non-dimensional pitch ratio which is defined as:

$$2*\pi*(r/R)/\tan(O) \text{ where}$$

r is the blade radius at a given section

R is the fan radius from hub center to tip, and

O is the chord angle as defined in FIG. 7.

The blade also has a tip curl that is illustrated by the numeral 40 in FIGS. 2–6. The tip curl can be expressed in terms of a non-dimensional projected width and a non-dimensional blade length, as these two terms are defined in FIG. 7. The non-dimensional projected width at a particular distance along the blade is determined by taking the mean projected width at the non-dimensional radius where the tip curl begins and dividing this value into the projected width at the particular distance The non-dimensional blade length is the blade chord length multiplied by the sine of the blade chord angle divided into X (FIG. 7). The length of X is referenced from the leading edge of the fan blade along the tip curl.

Figure 9:
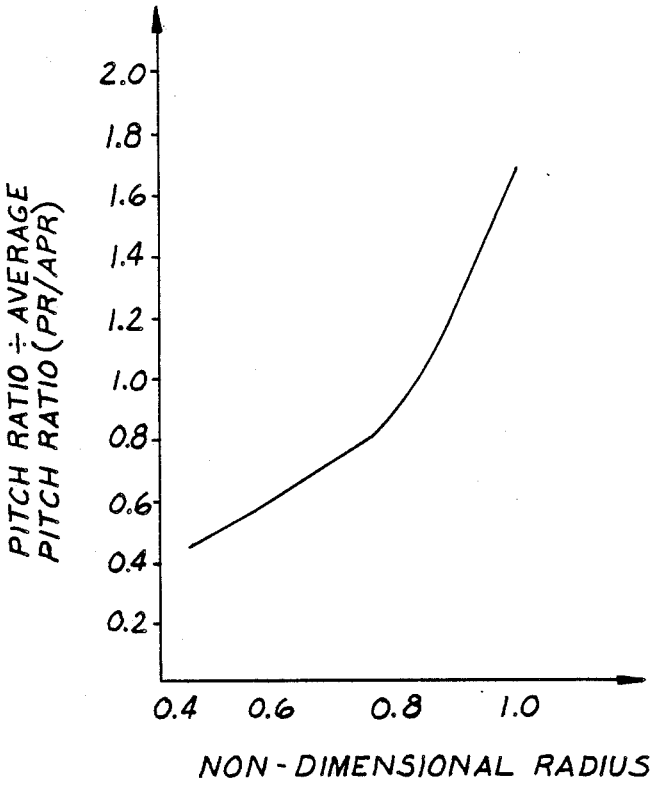
Figure 10:
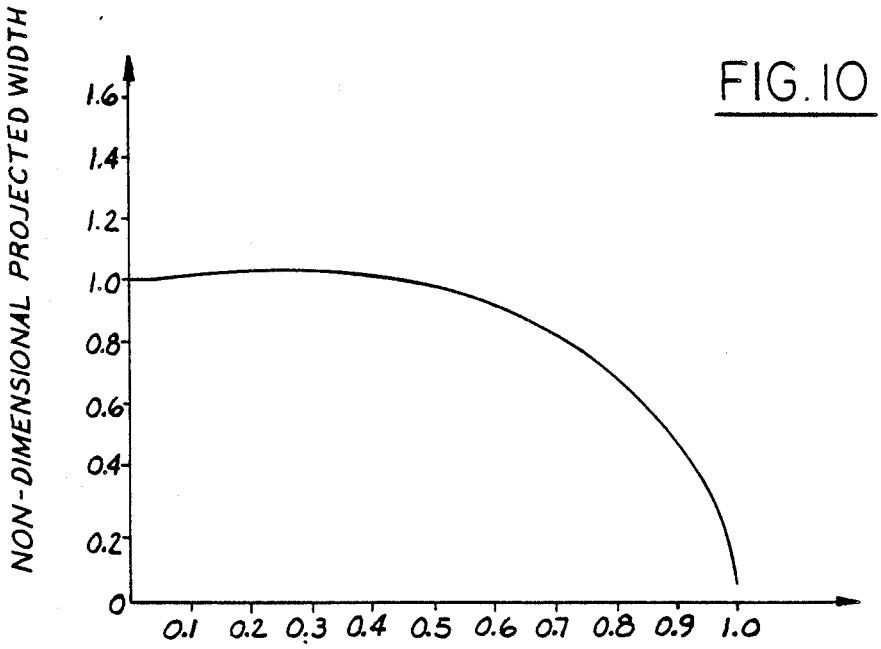

The preferred blade parameters are graphically portrayed by the graphs of FIGS. 8, 9, and 10. The inner zone 34 of the blade leading edge extends from a non-dimensional radius of 0.45 to 0.57; the intermediate zone 36 from 0.57 to 0.88; and the outer zone 38 from 0.88 to 1.00. The drawing illustration does not show the inner zone as being exactly non-skewed, but rather shows the blade widening as it approaches the hub. This is done for strengthening purposes.

The preferred tip curl starts at a non-dimensional radius of 0.91 and is of constant curvature.

The non-dimensional projected width as a function of blade length is shown in FIG. 10. From the non-dimensional blade length from 0 to 0.035, the non-dimensional projected width is constant; from 0.035 to 0.2 it continuously increases; and from 0.2 to 1.0 it continuously decreases.

Certain other considerations are important. The blade angle of skew must not exceed 40 degrees at a non-dimensional radius of 0.88, and at a non-dimensional radius of 0.7 the blade angle of skew should be at least 0 degrees. The tip curl must maintain a constant non-dimensional projected width for at least the first three percent of the non-dimensional blade length. In the non-dimensional blade length region of 0.03 to 0.2 the non-dimensional projected width increases continuously and should be at least 3.5 percent greater than the mean projected width at a non-dimensional radius of 0.91. For the remaining non-dimensional blade length region of 0.2 to 1.0 the non-dimensional projected width decreases continuously.

The innovative blade design makes it possible for a clutch fan to exhibit a significant noise reduction and at the same time the blade design is such that the fan efficiency makes it possible to reduce the clutch size creating the opportunity for cost and weight savings. The attenuation of fan noise is the result of the forwardly skewed leading edge along with the tip curl. The combination of these two blade features enables the fan to achieve performance comparable to a plastic electric motor operated cooling fan. In comparison to metal clutch fans, the fan of the present invention exhibits a noise reduction of from 6 to 8 db.

While a preferred embodiment of the invention has been disclosed and described, it will be understood that principles are applicable to other equivalent embodiments.

What is claimed is:

1. A fan comprising a number of blades that are uniformly arranged about a hub, said blades being substantially identical, each blade comprising a leading edge that has inner, intermediate, and outer zones, said intermediate zone being forwardly skewed and said outer zone being rearwardly skewed to the blade's trailing edge, said blade also having a pitch ratio that is continuously increasing with blade radius, and a tip curl in the outer zone in which the blade's leading edge is rearwardly skewed.

2. A fan as set forth in claim 1 in which said intermediate zone lies between a non-dimensional radius of 0.57 and 0.88 and said outer zone between a non-dimensional radius of 0.88 and 1.00.

3. A fan as set forth in claim 2 in which said tip curl begins at a non-dimensional radius of 0.91 and is substantially constant.

* * * * *